US005374944A

United States Patent [19]

Janosky et al.

[11] Patent Number: 5,374,944

[45] Date of Patent: Dec. 20, 1994

[54] THERMAL PRINTING WITH IMPROVED TEMPERATURE CONTROL

[75] Inventors: Mark S. Janosky; Robert R. Brearey, both of Rochester, N.Y.

[73] Assignee: Eastman Kodak Company, Rochester, N.Y.

[21] Appl. No.: 939,761

[22] Filed: Sep. 2, 1992

[51] Int. Cl.[5] ..... B41J 29/377; B41J 2/375; B41J 2/32

[52] U.S. Cl. ..... 346/76 PH; 400/719

[58] Field of Search ..... 346/76 PH; 400/719, 400/120

[56] References Cited

U.S. PATENT DOCUMENTS

| | | | |
|---|---|---|---|
| 4,777,560 | 10/1988 | Herrell et al. | 361/384 |
| 4,819,011 | 4/1989 | Yokota | 346/76 PH |
| 4,896,166 | 1/1990 | Barker et al. | 346/76 PH |
| 4,896,168 | 1/1990 | Newman et al. | 346/107 R |
| 5,083,194 | 1/1992 | Bartilson | 357/81 |
| 5,099,910 | 3/1992 | Walpole et al. | 165/80.4 |

*Primary Examiner*—Benjamin R. Fuller

*Assistant Examiner*—Huan Tran

*Attorney, Agent, or Firm*—Milton S. Sales

[57] ABSTRACT

A thermal printer is disclosed in which an image is generated on a line-by-line basis with a printhead that is comprised of a plurality of individually activated resistor elements along its length. Uniformity of image intensity is achieved by carefully controlling an ambient temperature of the printing head. This control of ambient temperature is achieved with a cooling fin that is thermally coupled to the printhead. A duct surrounds the cooling fin and air is blown through the duct to transfer heat from the cooling fin. The shapes of the cooling fin and the duct are such that the printhead is maintained at a substantially uniform temperature along its length. A unit cross-sectional area of the duct and a unit surface area of the cooling fin vary along the length of the printhead in a accordance with the expression: Q=unit surface area of cooling fin/unit cross-sectional area of duct=$k/L^n$, where k is a constant, L is a distance along the length of the printhead an n is a positive exponential power. In a preferred embodiment, n is between about 1.5 and 3.0.

14 Claims, 3 Drawing Sheets

THERMAL PRINTING WITH IMPROVED TEMPERATURE CONTROL

FIELD OF THE INVENTION

The present invention relates to the field of printing, and more particularly, to the field of thermal printing of multi-color images.

BACKGROUND OF THE INVENTION

In certain types of thermal printers, a receiver of print medium, such as paper, and a dye-donor film are moved past a print head as the print head causes an image to be transferred to the receiver. The receiver is moved past the print head in a series of repetitive passes. Each pass is made using a different color dye-donor film. In this manner, a series of overlying colored images are generated on the receiver. When the overlying images are properly registered with one another, the resultant image on the receiver is a full color image.

The printhead in this the of printer is constructed as a strip of discrete resistor elements. The strip of resistor elements is long enough to span an entire width of a receiver. Each resistor element can be activated independently. When a resistor element is activated, or "on", heat from the element produces a transfer of a spot of dye from the dye-donor film to the receiver.

As the receiver is transported across the printhead an image is formed as a series of lines. Each line of the image is unite. Each line is formed by a unique combination of the resistor elements being on or off.

In order to produce high resolution color images, it is necessary to produce very small dots of the transferred dye. This requires that the resistor elements be correspondingly small and very closely spaced on the printhead. In a typical thermal printer, a printhead is six to eight inches long and is comprised of thousands of resistor elements.

As each resistor element is turned on, some of the energy delivered to the element is transferred to the dye. However, a large portion of the energy remains in the printhead as residual energy. With continued operation of the printhead, this residual energy accumulates and causes a gradual overall heating of the printhead. As the ambient temperature of the printhead changes, its printing characteristics change. A printhead which is excessively hot, for example, will produce images which are smeared and unclear.

Thermal printers are designed to control the temperature of a printhead thereof. A typical prior art technique of controlling the temperature of a printhead makes use of a single feedback temperature device such as a thermocouple or thermistor in conjunction with a cooling system that consists of cooling fans and a heat sink on the back of the printhead. If the temperature of the printhead reaches a predetermined level, the cooling fans are turned on in an attempt to maintain the printhead/heat sink at a preselected temperature. However, although the thermal diffusion of the printhead/heat sink is generally fast, the ability of the fans to maintain true uniform control is limited. One example of an arrangement which uses cooling fins is disclosed in U.S. Pat. No. 4,896,166 (Barker et al.), issued Jan. 23, 1990.

There have been suggested a variety of other techniques to control temperature of printheads which have employed elaborate cooling systems. For example, a thermal printer disclosed in U.S. Pat. No. 4,819,011 (Y. Yokota), issued Apr. 4, 1989, employs a heat pipe and a thermoelectric transducer to maintain temperature control of a printhead. Such an elaborate system is not practical in thermal printers which are designed for use in typical office settings. A thermal printer for an office setting is designed to be used in conjunction with a personal computer as an adjunct or a substitute for a laser printer. In this context, the thermal printer must be marketed at a relatively low price. Consequently, the manufacturing cost of such a thermal printer must be held to a very low level, in the order of a few hundred dollars. Elaborate heat pipe and thermoelectric transducer temperature control systems are not economically practical in these office-setting thermal printers.

It is desirable therefore to produce a low cost thermal printer with a printhead/heat sink that can be maintained at essentially a uniform temperature throughout irrespective of the usage profile of the printer.

SUMMARY OF THE INVENTION

The present invention is directed to a color thermal printer in which a simple temperature control system is employed to maintain a constant ambient temperature of a printhead. The printhead is provided with a duct-enclosed, cooling fin aligned along the length of the printhead. A source of cooling air directs cooling air into one end of the duct and along the cooling fin. The air gets progressively warmer as it passes along the cooling fin. However, the cooling fin and duct are shaped so that the cooling fin remains at a substantially uniform temperature along its length. Consequently, the printhead is maintained at a desired temperature throughout its length.

Viewed from one aspect, the invention is directed to a thermal printer which comprises a means to transport a receiver through the thermal printer and a printhead having a length that is oriented orthogonally to a direction in which the receiver passes through the thermal printer. A cooling fin is coupled to the printhead along the length of the printhead and is adapted to transfer heat energy therefrom. The cooling fin has a unit surface area that is defined as a function of the length along the printhead. A duct surrounds the cooling fin and conveys air along the cooling fin. The duct has an input end and an output end. The duct has a unit cross-sectional area that is defined as a function of the length along the printhead. Air is propelled into the input end of the duct at a desired initial velocity. The duct is adapted to control the velocity of air passing therethrough as a function of the cross-sectional area of the duct, with the resultant velocity at any point along the length of the printhead being a unit velocity. An arithmetic product of the unit surface area of the cooling fin and the unit velocity of air in the duct increases along the length of the printhead from the input end of the duct to the output end of the duct whereby the printhead is maintained at a desired uniform ambient temperature along its length.

Viewed from another aspect, the invention is directed to a thermal printer which produces an image on a receiver on a line-by-line basis. The thermal printer comprises a printhead having a length that is substantially equal to a length of each of the lines of the image and a cooling fin coupled to the printhead along a substantial portion of the length of the printhead and adapted to transfer heat energy therefrom. Air is propelled along the cooling fin in a direction substantially along the length of the printhead from one end of the printhead to an opposite end of the printhead. The air is accelerated so that the air moves with a continually increasing velocity as it progresses along the length of the printhead whereby the air flow produces a desired amount of heat transfer from any particular portion of the cooling fin and the printhead is maintained at a desired ambient temperature at any point along its length.

Viewed from yet another aspect, the present invention is directed to a thermal printer which comprises means to transport a receiver through the thermal printer in a first direction and a printhead having a length that is oriented orthogonally to the direction in which the receiver passes through the thermal printer. A cooling fin is coupled to the printhead and is adapted to transfer heat energy therefrom. The cooling fin has a length which is substantially the same as the length of the printhead. Air is propelled along the cooling fin in a direction substantially parallel to the length of the printhead from one end of the printhead to an opposite end of the printhead. The cooling fin has a varying heat transfer capability along its length such that air flow along the length of the cooling fin produces a desired amount of heat transfer from any particular portion of the cooling fin, whereby the printhead is maintained at a desired ambient temperature at any point along its axis.

Viewed from still another aspect, the invention is directed to a method of thermally printing an image on a receiver. The method comprises the steps of transporting a receiver through the thermal printer in a first direction, generating an image on the receiver with a thermal printhead on a line-by-line basis, with the lines being oriented orthogonally to the direction in which the receiver is transported and maintaining a desired ambient temperature in the printhead with a cooling fin coupled to the printhead along the length of the printhead and adapted to transfer heat energy therefrom. The cooling fin has a unit surface area that is defined as a function of the length along the printhead. The step of maintaining a desired ambient temperature is accomplished by propelling air through a duct surrounding the cooling fin. The duct has an input end and an output end. The duct has a unit cross-sectional area that is defined as a function of the length along the printhead. The duct controls the velocity of air passing therethrough as a function of the cross-sectional area of the duct, the resultant velocity at any point along the length of the printhead being a unit velocity. An arithmetic product of the unit surface area of the cooling fin and the unit velocity of air in the duct increases along the length of the printhead from the input end of the duct to the output end of the duct whereby the printhead is maintained at a desired uniform ambient temperature along its length.

The invention will be better understood from the following detailed description taken in consideration with the accompanying drawings and claims.

The drawings are not necessarily to scale.

DETAILED DESCRIPTION

Figure 1:
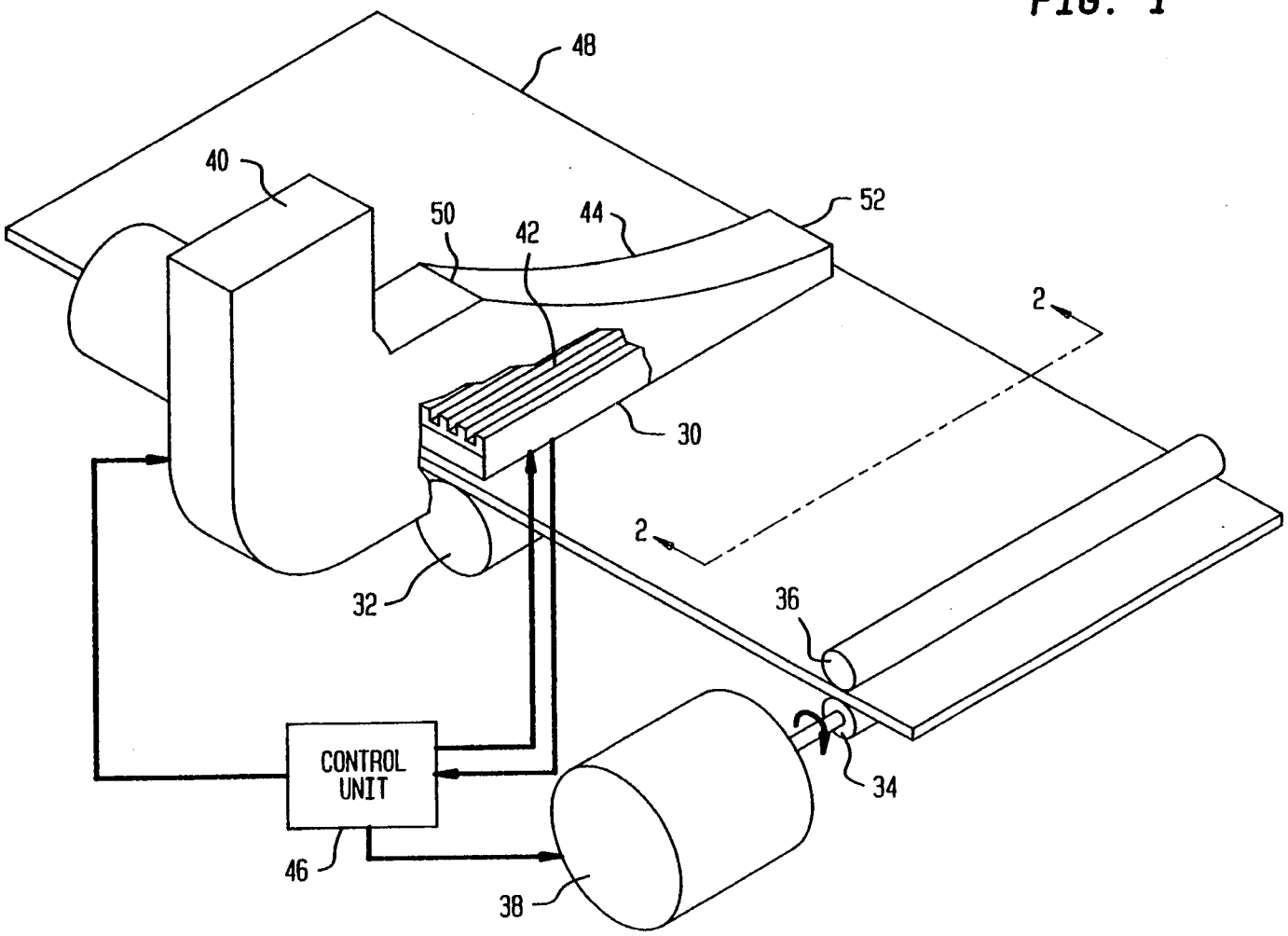
FIG. 1 is a schematic perspective view of a thermal printer in accordance with the present invention.

Referring now to FIG. 1, there is shown a schematic view of a thermal printer 20 in accordance with the present invention. Some portions of the thermal printer 20 are shown broken away for purposes of clarity. The thermal printer 20 comprises a printhead 30, a roller platen 32, a driving roller 34, a back-up roller 36, a drive motor 38, a cooling fan 40, a cooling fin 42, a duct 44 having an input end 50 and an output end 52, and a control unit 46. A receiver 48 of a printing medium is shown in position in the thermal printer 20. The print head 30 presses against the receiver 48 and an interposed layer of dye-donor film (not shown for purposes of clarity). The receiver 48 is supported by the roller platen 32. The printhead 30, the drive motor 38 and the cooling fan 40 are coupled to first, second and third outputs, respectively, of the control unit 46. An output of the printhead 30 is coupled to an input of the control unit 46. The drive motor 38 is coupled to the driving roller 34. The driving roller 34 bears against the receiver 48 and the back-up roller 36. The cooling fin 42 is thermally coupled to the printhead 30. The duct 44 surrounds the cooling fin 42. The cooling fan 40 is coupled to the duct 44.

In operation, the thermal printer 20 produces an image on the receiver 48 as the receiver 48 is moved across the printhead 30 in a series of repetitive passes. A dye donor film (not shown) with a repeating pattern of cyan, magenta, yellow and black dye patches is interposed between the printhead 30 and the receiver 48 in a well known manner. With each successive pass of the receiver 48 across the printhead 30, a single color image is formed corresponding to the color of the particular dye patch in position for that particular pass. In a conventional manner, dye from the dye donor film is transferred to the receiver 48 as a collection of dye dots that form a series of lines of a single color image. A single color image is formed on a line-by-line basis. With successive passes of the receiver 48, additional single color images are superimposed on one another, and a full color image is thus generated by the thermal printer 20.

The printhead 30 is comprised of a plurality of individual conventional resistor elements (not shown). Each of the resistor elements is activated in response to signals from the control unit 46 in a conventional manner. For any given line of an image, an individual resistor unit may be energized or de-energized, depending on whether or not a desired image requires dye at the location of that particular resistor element. Dye dots transferred to the receiver 48 occur as a result of sublimation of dye from the dye donor film. This sublimation is caused by heat produced by energized resistor elements.

In order to produce images with high resolution, it is necessary to use a great many discreet dye dots for generation of the image. Thus the printhead 30 must be comprised of a great many closely spaced individual resistor elements. On a typical thermal printer designed to operate with receivers about eight inches wide, a printhead has literally thousands of resistor elements along its length.

In an ideal printing system, each of the resistor elements would become instantaneously hot when energized and instantaneously cold when de-energized. This would result in each dot of dye being transferred to the receiver 48 with the same intensity as all other dots of dye. However, because the resistor elements are so closely spaced along the length of the printhead 30, residual heat remains in the printhead 30 from each activation or energization of one of the resistor elements. This residual heat, if left uncontrolled, results in a gradual and overall increase in temperature of the entire printhead 30. As the overall temperature of the printhead 30 changes, there is a corresponding change of intensity of the transferred dye dots. This is manifested as non-uniformity of the images that are generated by the thermal printer 20.

The cooling fin 42 performs a heat transferring function that is useful in maintaining uniform temperature of the printhead 30. In one embodiment of the present invention, the cooling fin is constructed of high conductivity aluminum. The cooling fin 42 is tightly secured to a metal housing of the printhead 30 to produce an effective heat transfer interface between the cooling fin 42 and the printhead 30. The duct 44 surrounds the cooling fin 42 and directs air from the cooling fan 40 along the cooling fin 42.

In the embodiment of the thermal printer 20 shown in FIG. 1, the cooling fin 42 has a substantially uniform surface area along the entire length of the printhead 30. The cooling fan 40 is positioned to blow air into the input end 50 of the duct 44. As air progresses along the cooling fin 42, heat is transferred to the air and the temperature of the air increases. As the temperature of the air increases, its cooling effectiveness decreases. Thus, if the air were permitted to blow across the cooling fin 42 at a constant velocity, the cooling fin 42 would transfer varying amounts of energy along its length. The cooling fin 42 would be cooler near the input end 50 of the duct 44 and hotter at the output end 52. Such non-uniformity of temperature along the length of the cooling fin 42 and the printhead 30 would result in a corresponding non-uniformity in image intensity across the width of the receiver 48. The shape of the duct 44 precludes this anomalous non-uniformity.

The duct 44 has a varying cross-sectional area along its length. At the input end 50, the duct has a relatively large cross-sectional area. Air from the cooling fan 40 moves relatively slowly at the input end 50. The cross-sectional area of the duct 44 progressively decreases along its length so that the area is at a minimum at the output end 52. The decreasing cross-sectional area results in a progressive increase in velocity of the air in the duct 44 as the air passes to the output end 52. Thus even though the air increases in temperature as it passes toward the output end 52, the heat transfer capability of the air remains substantially constant because of its increased velocity. Consequently, the cooling fin 42 is maintained at a substantially uniform temperature along the entire length of the printhead 30. We have found that a uniform temperature along the entire length of the printhead 30 is maintained when the duct 44 is provided with a cross-sectional area that decreases exponentially along its length.

In the context of a thermal printer designed for use in an office setting, the above described cooling system is very cost effective. The cooling fan 40 is an inexpensive conventional unit. The cooling fan 40 is attached to the duct 44 with a simple bolted connection. The duct 44 is a simple part made from molded plastic. The combination of these parts adds very little to the overall cost of the thermal printer 20; however the quality of the images produced by the thermal printer 20 is substantially improved.

In one embodiment of the thermal printer 20, the cooling fan 40 is driven by a variable speed motor (not shown). The printhead 30 is provided with a conventional temperature sensing device (not shown). The temperature sensing device transmits an output temperature signal to the control unit 46. The cooling fan 40 is adapted to operate at a nominal speed for an expected ambient temperature of the printhead 30. When the ambient temperature of the printhead 30 exceeds the expected temperature, the control unit 46 produces a signal, with conventional circuitry (not shown), to increase the speed of the cooling fan 40. Conversely, a lower than expected ambient temperature in the printhead 30 is translated into a reduction in speed of the cooling fan 40. Thus the thermal printer 20 is capable of producing highly uniform images irrespective of whether the thermal printer 20 is used continuously at full capacity or only intermittently.

Figure 2:
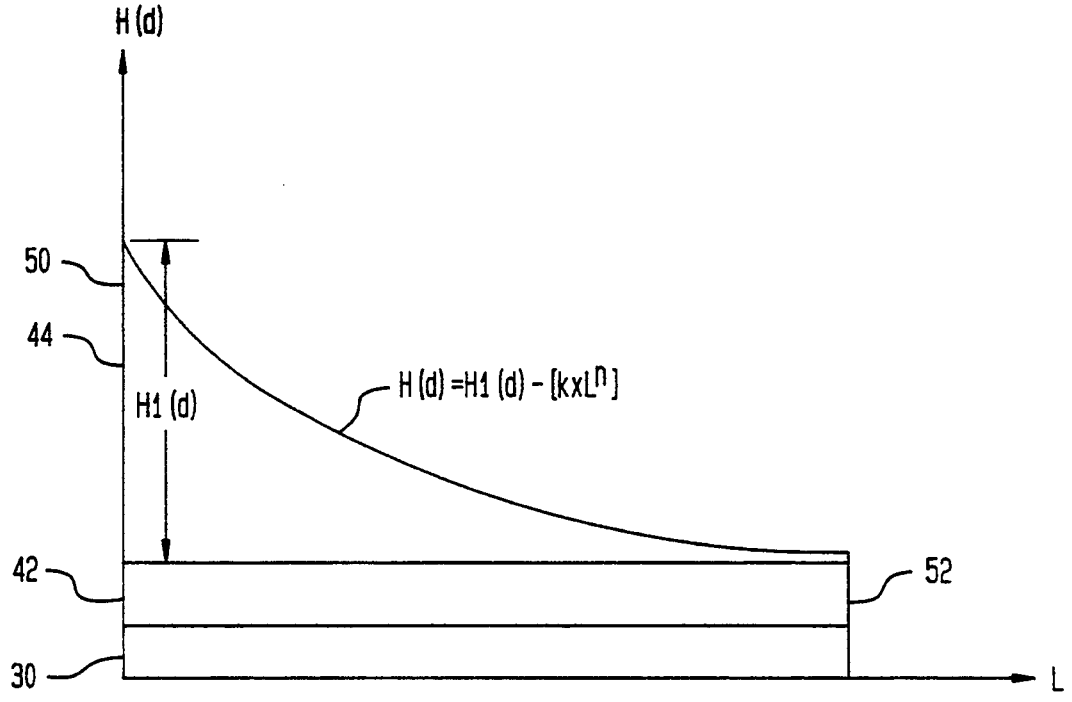
FIG. 2 is a elevational view of a portion of the thermal printer of FIG. 1.

Referring now to FIG. 2, there is shown a partial view of the thermal printer 20 taken along a dashed line 2—2 of FIG. 1. The printhead 30, the cooling fin 42 and a portion of the duct 44 are shown. The input end 50 and the output end 52 of the duct 44 are shown. All other portions of the thermal printer 20 are deleted for purposes of clarity and simplicity.

Two directional arrows, designated H(d) and L, are included in FIG. 2. The arrow H(d) is indicative of a unit height of the duct 44 and the arrow L is indicative of a length along the printhead 30. The symbols H(d) and L are used hereinbelow to describe an interrelationship between the unit height of the duct 44 and any particular distance along the length of the printhead 30 from the input end 50 of the duct 44. A relationship between the height of the duct 44 and the length along the printhead 30 is shown and discussed for purposes of simplicity. It should be understood that, in the embodiment of the thermal printer 20 shown in FIG. 2, the duct 44 has a uniform width along its length. Thus its height at any particular point along its length is also definitive of its cross-sectional area. In this context, FIG. 2 and the following description show a relationship between a unit cross-sectional area of the duct 44 and a length along the printhead 30.

It can be seen that the height of the duct 44 progressively decreases along the length of the printhead 30. FIG. 2 shows the duct 44 having an initial height H1(d) at the input end 50. FIG. 2 also shows that the unit height H(d) of the duct 44 varies along the length L of the printhead 30 in accordance with the mathematical expression: $H(d)=H1(d)-[k\times L^n]$, where H1(d) is an initial height of the duct 44, k is a constant, L is a linear distance along the length of the printhead 30 from the input end 50 of the duct 44 and n is a positive exponential power of L. Similarly, it can be understood that the duct 44 has a relationship between its unit cross-sectional area and its length along the printhead which is defined by the expression, $A(d)=W(d)\times H(d)$, where A(d) is the unit cross-sectional area, W(d) is a width of the duct 44 and H(d) is the unit height of the duct 44. We have found that the thermal printer 20 produces very desirable results when the unit cross-sectional area of the duct 44 varies along the length of the printhead 30 at an exponential rate defined by n being between about 1.5 and 3.0. A preferred range for n is about 2.0 to 3.0. In a typical embodiment n is 2.5.

Figure 3:
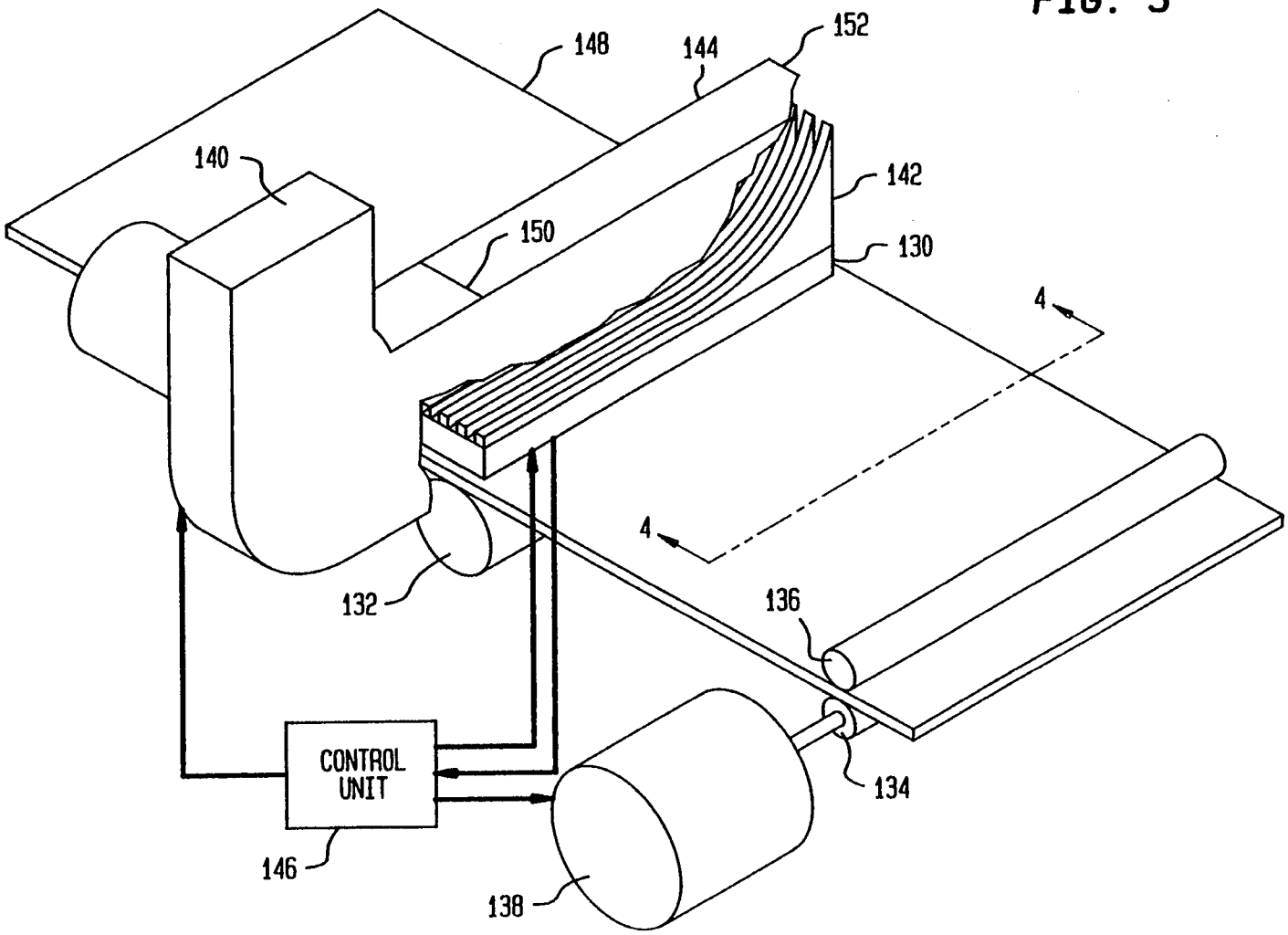
FIG. 3 is a schematic perspective view of another thermal printer in accordance with the present invention.

Referring now to FIG. 3, there is shown a schematic view of a thermal printer 120 in accordance with the present invention. Some portions of the thermal printer 120 are shown broken away for purposes of clarity. The thermal printer 120 comprises a printhead 130, a roller platen 132, a driving roller 134, a back-up roller 136, a drive motor 138, a cooling fan 140, a cooling fin 142, a duct 144 having an input end 150 and an output end 152, and a control unit 146. A receiver 148 of a printing medium is shown in position in the thermal printer 120. The printhead 130 presses against the receiver 48 and an interposed layer of dye-donor film (not shown for purposes of clarity). The receiver 148 is supported by the roller platen 132. The printhead 130, the drive motor 138 and the cooling fan 140 are coupled to first, second and third outputs, respectively, of the control unit 146. An output of the printhead 130 is coupled to an input of the control unit 146. The drive motor 138 is coupled to the driving roller 134. The driving roller 134 bears against the receiver 148 and the back-up roller 136. The cooling fin 142 is thermally coupled to the printhead 130. The duct 144 surrounds the cooling fin 142. The cooling fan 140 is coupled to the duct 144.

In operation, the thermal printer 120 produces an image on the receiver 148 as the receiver 148 is moved across the printhead 130 in a series of repetitive passes. The image is produced in the same manner as described above with respect to the thermal printer 20 shown in FIG. 1.

The printhead 130 is comprised of a plurality of individual conventional resistor elements (not shown). Each of the resistor elements is activated in response to signals from the control unit 146 in a conventional manner. The resistor elements of the printhead 130 operate in the same manner as the resistor elements of the printhead 30 of the thermal printer 20 shown in FIG. 1.

The cooling fin 142 performs a heat transferring function that is useful in maintaining a relatively uniform temperature of the printhead 130. In an illustrative embodiment of the thermal printer 120, the cooling fin 142 is constructed of high conductivity aluminum. The cooling fin 142 is tightly secured to a metal housing of the printhead 130 so that an effective heat transfer interface is produced between the cooling fin 142 and the printhead 130. The duct 144 surrounds the cooling fin 142 and directs air from the cooling fan 140 across the cooling fin 142.

The duct 144 has a substantially uniform cross-sectional area along the entire length of the printhead 130. The cooling fan 140 is positioned to blow air into the input end 150 of the duct 144. As air progresses across the cooling fin 142, heat is transferred to the air and the temperature of the air increases. As the temperature of the air increases, its cooling effectiveness decreases.

The cooling fin 142 has a varying cross-sectional area along its length. At the input end 150, the cooling fin 142 has a relatively small surface area. Air from the cooling fan 140 has a relatively low temperature at the input end 150. The relatively cool air absorbs a high amount of heat energy from the relatively low surface area of the cooling fin 142. The surface area of the cooling fin 142 progressively increases along its length so that it is at its maximum at the output end 152. The increasing surface area results in a progressive increase in heat transfer capability of each unit length of the cooling fin 142. Thus even though the air increases in temperature as it passes toward the output end 52, the heat transfer capability of the air remains substantially constant because it passes across an ever increasing surface area of the cooling fin 142. Consequently, the cooling fin 142 transfers a substantially uniform amount of energy along the entire length of the printhead 130 and the printhead 130 is maintained at a substantially uniform ambient temperature along its entire length. We have found that a uniform temperature along the entire length of the printhead 130 is maintained when the cooling fin 142 is provided with a surface area that increases exponentially along its length.

In the context of a thermal printer designed for use in an office setting, the above described cooling system is very cost effective. The cooling fan 140 is an inexpensive conventional unit. The cooling fan 140 is attached to the duct 144 with a simple bolted connection. The duct 144 is a simple part made from molded plastic. In a typical embodiment, the cooling fin 142 is a diecast aluminum part that is produced at a low unit cost in high volumes. The combination of these parts adds very little to the overall cost of the thermal printer 120. But, the quality of the images produced by the thermal printer 120 is substantially improved.

In one embodiment of the thermal printer 120, the cooling fan 140 is driven by a variable speed motor (not shown). The printhead 130 is provided with a conventional temperature sensing device (not shown). The temperature sensing device transmits an output temperature signal to the control unit 146. The cooling fan 140 operates at a nominal speed for an expected ambient temperature of the printhead 130. When the ambient temperature of the printhead 130 exceeds the expected temperature, the control unit 146 produces a signal, with conventional circuitry, to increase the speed of the cooling fan 140. Conversely, a lower than expected ambient temperature in the printhead 130 is translated into a reduction in speed of the cooling fan 140. Thus the thermal printer 120 is capable of producing highly uniform images irrespective of whether the thermal printer 120 is used continuously at full capacity or only intermittently.

Figure 4:
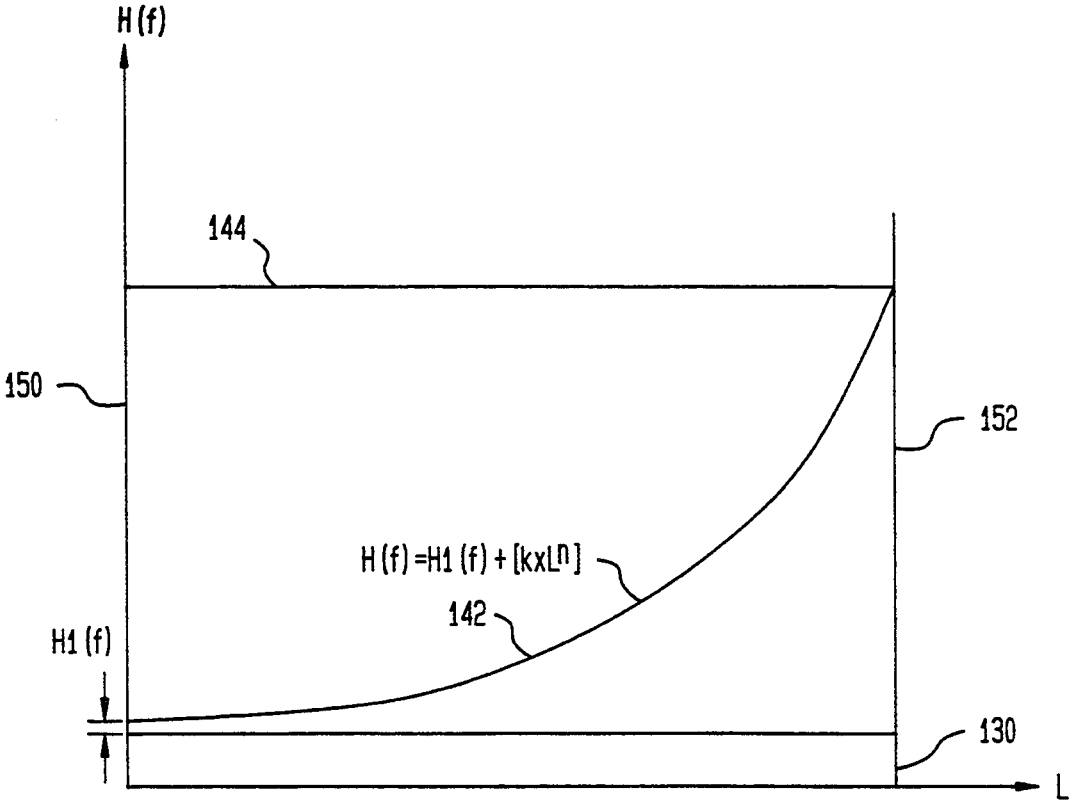
FIG. 4 is a elevational view of a portion of the thermal printer of FIG. 3.

Referring now to FIG. 4, there is shown a partial view of the thermal printer 120 taken along a dashed line 4—4 of FIG. 3. The printhead 130, the cooling fin 142 and a portion of the duct 144 are shown. The input end 150 and the output end 152 of the duct 144 are shown. All other portions of the thermal printer 120 are deleted for purposes of clarity and simplicity.

Two directional arrows, designated H(f) and L, are included in FIG. 4. The arrow H(f) is indicative of a unit height of the cooling fin 142 and the arrow L is indicative of a length along the printhead 130. The symbols H(f) and L are used hereinbelow to describe an interrelationship between the unit height of the cooling fin 142 and any particular distance along the length of the printhead 130 from the input end 150 of the duct 144. A relationship between the height of the cooling fin 142 and the length along the printhead 130 is shown and discussed for purposes of simplicity. It should be understood that, in the embodiment of the thermal printer 120 shown in FIG. 4, the cooling fin 142 has a uniform width along its length. Thus its height at any particular point along its length is also definitive of its surface area. In this context, FIG. 4 and the following description show a relationship between a unit surface area of the cooling fin 142 and a length along the printhead 130.

It can be seen that the height of the cooling fin 142 progressively increases along the length of the printhead 130. FIG. 4 shows the cooling fin 142 having an initial height H1(f) at the input end 150 of the duct 144. FIG. 4 also shows that the unit height H(f) of the cooling fin 142 varies along the length L of the printhead 130 in accordance with the mathematical expression: $H(f)=H1(f)+[k\times L^n]$, where H1(f) is the initial height of the cooling fin 142, k is a constant, L is a linear distance along the length of the printhead 130 from the input end 150 of the duct 144 and n is a positive exponential power of L. Similarly, it can be understood that the cooling fin 142 has a relationship between its unit surface area and its length along the printhead 130 which is defined by the following expression: $A(f)=W(f)\times H(f)$, where A(f) is the unit surface area, W(f) is a width of the cooling fin 142, and H(f) is the unit height of the cooling fin 142.

We have found that the thermal printer 120 produces very desirable results when the surface area of the cooling fin 142 varies along the length of the printhead 130 at an exponential rate defined by n being between about 1.5 and 3.0.

Referring now back to FIGS. 2 and 4, it can be seen that the two embodiments of the inventive thermal printer 20 and 120 have a generic similarity that is explained hereinbelow.

In the case of the thermal printer 20, the unit surface area of the cooling fin 42 remains substantially constant along the length of the printhead 30. The unit cross-sectional area of the duct 44 decreases along the length of the printhead 30. This decreasing cross-sectional area produces a corresponding increase in unit velocity of the air in the duct 44. At any point along the length of the printhead 32, the overall heat transferring capability of the combined cooling fin 42 and duct 44 is a function of the arithmetic product of the unit velocity of the air and the unit surface area of the cooling fin 42. It can be seen that this arithmetic product increases along the length of the printhead 32 from the input end 50 to the output end 52 of the duct 44.

Similarly, in the case of the thermal printer 120, the arithmetic product of the surface area of the cooling fin 142 and the unit velocity of the air in the duct 144 increases along the length of the printhead 130. As air passes from the input ends of the ducts 44 and 144, the temperature of the air increases. But in both the thermal printers 20 and 120, the printheads 30 and 130 are maintained at a substantially uniform ambient temperature along their respective lengths. It can be seen that maintenance of this uniformity of ambient temperature is achieved by either increasing air velocity or increasing surface area of the cooling fin. Indeed, it is possible to maintain a desired uniformity of ambient temperature in a printhead by using a cooling fin with a varying surface area and a duct with a varying cross-sectional area. We have found that virtually any combination of variations are effective if the variations are consistent with the following generic mathematical expression:

$$P = \text{unit surface area of cooling fin} \times \text{unit air velocity} = k \times L^n$$

where k is a constant, L is a linear distance from the input end of the duct along the length of the printhead and n is any desired positive exponential power of L.

It should be noted that any particular unit air velocity is inversely proportional to the unit cross-sectional area of the duct through the air is conveyed. Consequently, another way of expressing the above mathematical relationship is as follows:

$$Q = \text{unit surface area of cooling fin/unit cross-sectional area of duct} = k/L^n$$

where k is a constant, L is a linear distance from the input end of the duct along the length of the printhead and n is any desired positive exponential power of L. As discussed above, we have found that the thermal printers 20 and 120 produce high quality images when the exponential power n is between 1.5 an 3.0.

It is to be appreciated and understood that the specific embodiments of the invention are merely illustrative of the general principles of the invention. Various modifications may be made by those skilled in the art which are consistent with the principles set forth. For example, the cooling fins may be formed with many different shapes while still being effective to maintain a desired ambient temperature profile in a printhead. Similarly cooling air ducts may be made with various cross-sectional profiles that will be effective. Indeed, it is possible to produce variations in temperature profiles along the length of printheads if such a result is desired. This can be accomplished by making the heat transfer capability of the cooling fin and duct combination more effective or less effective at particular locations along the printhead. In this manner a printhead can, for example, be produced with higher ambient temperatures at its center. Or alternatively, a printhead can be provided with higher ambient temperature at its ends. These adjustments to printhead temperature profiles can be useful when specialized graphical images are being generated by a thermal printer.

What is claimed is:

1. A thermal printer having an apparatus for maintaining a printhead at a uniform temperature, said thermal printer comprising:

means for transporting a receiver through the thermal printer along a receiver path;

a printhead having a length that is oriented orthogonally to the receiver path;

a cooling fin associated with the printhead and extending along the length of the printhead and adapted to receive heat energy from the printhead, the cooling fin having a cross-sectional surface area that is a function of the position along the length of the printhead;

a duct surrounding the cooling fin, the duct having an input end, an output end, and a cross-sectional area that is a function of the position along the printhead; and means for propelling air having a velocity into the input end of the duct at a desired initial velocity such that the velocity of air at any given position along the length of the printhead is a function of the cross-sectional area of the duct at the given position, said cooling fin and said duct being configured so that the arithmetic product of the cross-sectional surface area of the cooling fin and the velocity of air in the duct increases along the length of the printhead from the input end of the duct to the output end of the duct, whereby the increase in the product compensates for an increase in air temperature so as to maintain a generally constant heat transfer capability between the air and the cooling fin along the length of the printhead.

2. The thermal printer of claim 1 wherein:

the cooling fin has a substantially uniform cross-sectional surface area along the length of the printhead; and the duct has a cross-sectional area that decreases along the length of the printhead.

3. The thermal printer of claim 1 wherein:

the cooling fin has a cross-sectional surface area that increases along the length of the printhead; and the duct has a cross-sectional area that is substantially uniform along the length of the printhead.

4. The thermal printer of claim 1 wherein $P=k\times L^n$, where P is the arithmetic product of the cross-sectional surface area of the cooling fin and the velocity of air in the duct such that the product increases along the length of the printhead from the input end of the duct to the output end of the duct in accordance with the expression, cross-sectional surface area of the cooling fin, k is a constant, L is a linear distance from the input end of the duct along the length of the printhead, and n is any desired positive exponential power of L.

5. The thermal printer of claim 1 wherein:

the printhead is provided with means for sensing an ambient temperature of the printhead; and the means for propelling air is responsive to the means for sensing ambient temperature for varying the initial velocity of air.

6. The thermal printer of claim 4 wherein n is between about 1.5 to 3.0.

7. A thermal printer which produces an image on a receiver on a line-by-line basis comprising:

a printhead having a length that is substantially equal to a length of each of the lines of the image;

a cooling fin associated with the printhead along a substantial portion of the length of the printhead to receive heat energy from the printhead;

means for propelling air along the cooling fin in a direction substantially along the length of the printhead from one end of the printhead to an opposite end of the printhead, the air having a velocity temperature and heat transfer capability; and means for controlling the air so that the air moves with a varying velocity as it progresses along the length of the printhead such that an increase in velocity of air compensates for an increase in air temperature so as to maintain a generally constant heat transfer capability of the air.

8. The thermal printer of claim 7 wherein the air increases velocity exponentially relative to the distance which the air has moved along the length of the printhead.

9. The thermal printer of claim 7 wherein:

the means for propelling air comprises a duct which substantially surrounds the cooling fin and is oriented to convey air along the length of the printhead, the duct having (1) an input end located near said one end of the printhead and an output end located near said opposite end of the printhead and (2) a cross-sectional area that varies along the duct such that air blown into the duct at the input end is accelerated as it is propelled toward the output end of the duct; and the means for propelling air comprises a fan adapted to blow air into the input end of the duct.

10. The thermal printer of claim 7 wherein:

the printhead is provided with means for sensing an ambient temperature of the printhead; and the means for propelling air includes means for varying an initial velocity of air in response to signals from the means for sensing ambient temperature.

11. A thermal printer having an apparatus for maintaining a printhead at a uniform temperature, said thermal printer comprising:

means to transport a receiver through the thermal printer along a receiver path;

a printhead having a length that is oriented orthogonally to the receiver path;

a cooling fin associated with the printhead and extending along the length of the printhead to receive heat energy from the printhead, the cooling fin having a cross-sectional surface area that is a function of the position along the length of the printhead; and means for propelling air along the cooling fin in a direction substantially parallel to the length of the printhead from one end of the printhead to an opposite end of the printhead, the air having a temperature and heat transfer capability, the cooling fin having a heat transfer capability which is a function of its cross-sectional surface area such that said heat transfer capability of the cooling fin compensates for an increase in air temperature so as to maintain a generally constant heat transfer capability of the air.

12. The thermal printer of claim 11 wherein the cooling fin has a heat transfer capability that is lowest at said one end of the printhead, and the heat transfer capability of the cooling fin is highest at said opposite end of the printhead.

13. The thermal printer of claim 11 wherein:

the printhead is provided with means for sensing an ambient temperature of the printhead; and the means for propelling air is responsive to the means for sensing ambient temperature for varying an initial velocity of air.

14. The thermal printer of claim 11 wherein the cross-sectional surface area of the cooling fin increases exponentially along the length of the printhead.

* * * * *